United States Patent [19]

Shiba et al.

[11] 3,955,979

[45] May 11, 1976

[54] FLASH EXPOSURE OF SUPERSENSITIZED SILVER HALIDE PHOTOGRAPHIC LIGHT-SENSITIVE MATERIAL

[75] Inventors: Keisuke Shiba; Masanao Hinata; Hirotetu Kato, all of Minami-ashigara, Japan

[73] Assignee: Fuji Photo Film Co., Ltd., Minami-ashigara, Japan

[22] Filed: Mar. 24, 1975

[21] Appl. No.: 561,504

Related U.S. Application Data

[63] Continuation-in-part of Ser. No. 406,420, Oct. 15, 1973, abandoned, which is a continuation of Ser. No. 190,332, Oct. 18, 1971, abandoned.

[30] Foreign Application Priority Data

Oct. 16, 1970 Japan ..... 45-90950

[52] U.S. Cl. ..... 96/27 E; 96/108; 96/124

[51] Int. Cl.[2] ..... G03C 5/04

[58] Field of Search ..... 96/124, 27 E, 45.2

[56] References Cited

UNITED STATES PATENTS

| | | | |
|---|---|---|---|
| 3,594,172 | 7/1971 | Sincius | 96/45.2 |
| 3,617,293 | 11/1971 | Shiba et al. | 96/124 |
| 3,660,099 | 5/1972 | Sato et al. | 96/124 |
| 3,667,960 | 6/1972 | Shiba et al. | 96/124 |
| 3,808,008 | 4/1974 | Shiba et al. | 96/124 |
| 3,890,154 | 6/1975 | Ohkubo et al. | 96/126 |

*Primary Examiner*—J. Travis Brown
*Attorney, Agent, or Firm*—Sughrue, Rothwell, Mion, Zinn & Macpeak

[57] ABSTRACT

A silver halide photographic light-sensitive element suitable for exposure to light for a period of time of less than (preferably) 0.0001 second comprising a support bearing thereon at least one layer of a silver halide photographic emulsion, the silver halide photographic emulsion containing at least one sensitizing dye represented by the following General Formula (I) in combination with at least one sensitizing dye represented by the following General Formula (II):

General Formula (I)

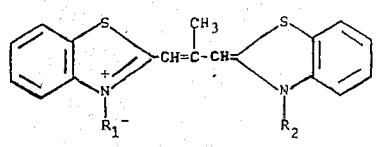

(I)

wherein $R_1$ and $R_2$ each represents an alkyl group, at least one of $R_1$ and $R_2$ being an alkyl group having a sulfo substituent;

General Formula (II)

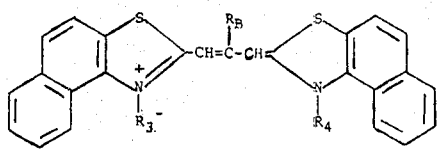

(II)

wherein $R_B$ represents a methyl group or an ethyl group, $R_3$ and $R_4$ have the same meaning as $R_1$ and $R_2$, at least one of $R_3$ and $R_4$ being an alkyl group having a sulfo substituent.

7 Claims, No Drawings

FLASH EXPOSURE OF SUPERSENSITIZED SILVER HALIDE PHOTOGRAPHIC LIGHT-SENSITIVE MATERIAL

CROSS-REFERENCE TO RELATED APPLICATIONS

This application is a continuation-in-part application of Ser. No. 406,420, filed Oct. 15, 1973 by Keisuke Shiba et al., now abandoned, which application is a continuation application of Ser. No. 190,332, filed Oct. 18, 1971 by Keisuke Shiba et al, now abandoned.

BACKGROUND OF THE INVENTION

1. Field of the Invention

This invention relates to a silver halide photographic light-sensitive element and particularly to a silver halide photographic light-sensitive element having a panchromatic sensitiveness upon "flash exposure" and in this case, the term "flash exposure" means one defined in the following description.

2. Description of the Prior Art

In this age of information, various systems have been developed and studied in order to attain quick transmission of information. For example, there are a press facsimile system for quickly transmitting manuscripts for a newspaper to a distant place, a high speed type photo-composing system in order to quickly set up in type, and a cathode ray tube display system for indicating information provided from an electronic computer as characters or patterns.

In machinery and tools for use in these quick information transmitting systems, a short time exposure of less than one-hundred thousandth second, particularly about one-millionth second is mostly adopted. In recent years, the demand for light-sensitive elements employed in such machinery and tools as mentioned above becomes particularly remarkable.

For the light sources employed in these machinery and tools, there are a xenon flash light source and a cathode ray light source other than a combination of a light source of a high illumination intensity such as a xenon-arc lamp and a high pressure mercury-arc lamp with a high speed shutter. In these light sources, such a type of cathode ray tube having particularly fluorescent material of a short after glow period and known generally as a flying spot use is employed. For example, various fluorescent materials such as so-called "P-11," "P-16," "P-22," "P-22D," "P-24," and the like are employed, respectively. In these fluorescent materials, it is generally known that P-11 has the maximum spectroscopic energy distribution of luminescence in a wavelength of 460 nonameters (hereinafter referred to simply as "nm"); the maximum of P-16 is in a wavelength of 385 nm; the maximum of P-24, 520 nm; the maxima of P-22D, 525 nm and 638 nm; other than 450 nm; and the maxima of P-22, 675 nm, other than 620 nm, respectively. For light-sensitive elements in which the above-mentioned various fluorescent materials are employed and which are adopted for recording an image on a cathode ray tube, it is required to impart thereto a panchromatic sensitivity broadened to the end of the red region (about 700 nm).

On the other hand, a light in a region of a comparatively wide wavelength radiates in the case when a xenon flash light source or xenon-arc light source is employed. However, the light emitted from a light source forms an image on the light-sensitive surface of a light-sensitive element through an optical system comprising a condenser lens, negative matrix, main lens, prism, reflector, and the other special lenses or prisms for converting characters. Therefore, concerning the light reaching the light-sensitive surface of the element, light of a short wavelength is absorbed much more than that of a wavelength by the above-mentioned optical system, so that the ratio of the light having a wavelength of from ultraviolet light to blue light decreases while the ratio of the light of a long wavelength increases. For this reason, a spectral sensitization becomes indispensable in order to elevate the sensitivity of the light-sensitive element.

The after-glow period of the luminescence of the above-described cathode ray tube is short, for example, from about one-ten millionth second to one-hundred thousandth second, and with respect to a xenon flash lamp, those having substantially the same short luminescent period as in the above cathode ray tube are mostly employed. In the present invention, a short period exposure by such kinds of light sources as mentioned above is defined as a "flash exposure."

In the case of a high pressure mercury-arc lamp, three bright lines existing in a range of from 300 nm to 370 nm and the lights of 405 nm and 436 nm are ineffective, similarly as in the case of the above xenon lamp, whereas bright lines existing in wavelengths of 546 nm and 577 nm are more effectively utilized than those in the former case. Therefore, a spectral sensitization becomes indispensable in order to elevate the sensitivity of a light-sensitive element.

SUMMARY OF THE INVENTION

It is an object of the present invention to provide a light-sensitive element which is spectrally sensitized over the end of the region so as to be capable of being employed commonly in machinery and tools for transmitting information in which the above-mentioned various light sources are employed and further, which has a high sensitivity when subjected to flash exposure.

The object of the present invention is attained by adding two kinds of carbocyanine dyes represented by the following General Formulae (I) and (II) to a silver halide photographic emulsion:

General Formula (I)

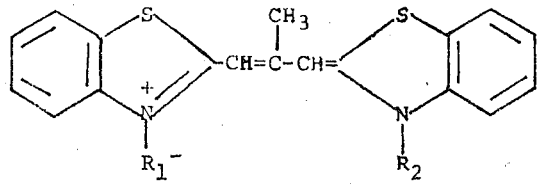

(I)

wherein $R_1$ and $R_2$ each represents an alkyl group, at least one of $R_1$ and $R_2$ being an alkyl group having a sulfo substituent, General Formula (II)

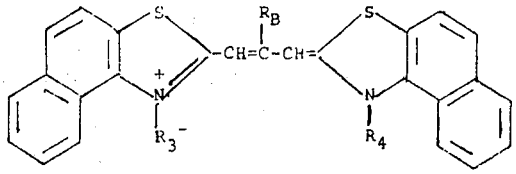

(II)

wherein $R_B$ represents a methyl group or an ethyl group, $R_3$ and $R_4$ have the same meaning as $R_1$ and $R_2$, at least one of $R_3$ and $R_4$ being an alkyl group having a sulfo substituent.

DESCRIPTION OF THE PREFERRED EMBODIMENTS

As examples of the dyes represented by General Formula (I) will be illustrated below, but it is to be noted that the dyes of the present invention are not to be limited to them:

I-1

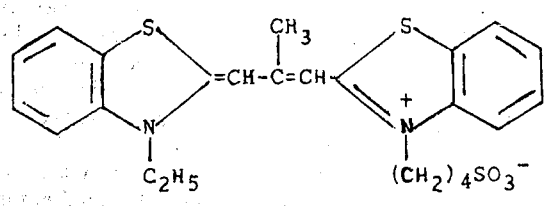

I-2

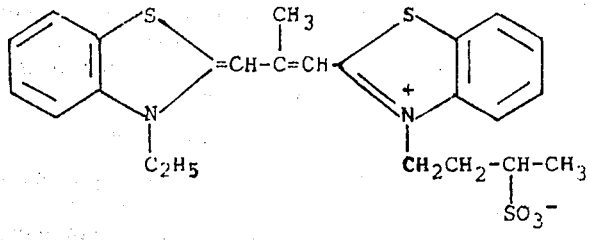

I-3

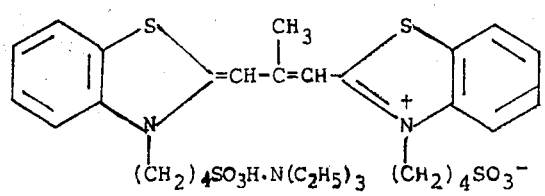

I-4

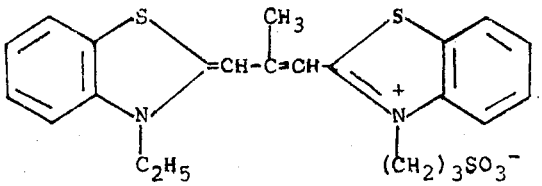

I-5

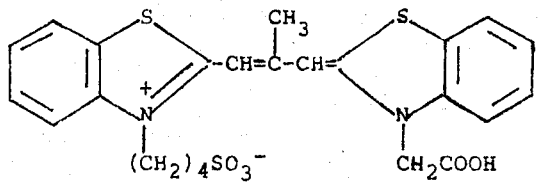

I-6

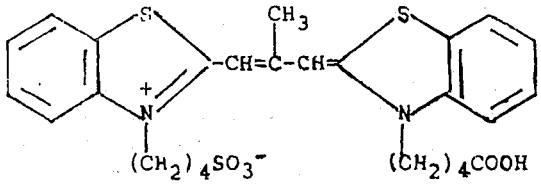

Furthermore, as examples of the dyes of General Formula (II) will be illustrated hereinbelow, but it is to be noted that the dyes of the present invention are not to be limited to them.

II-1

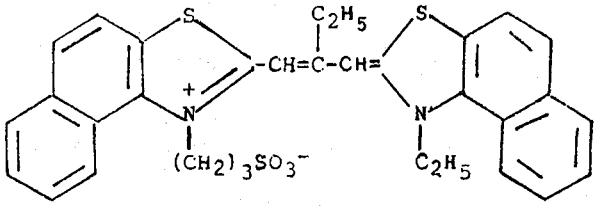

II-2

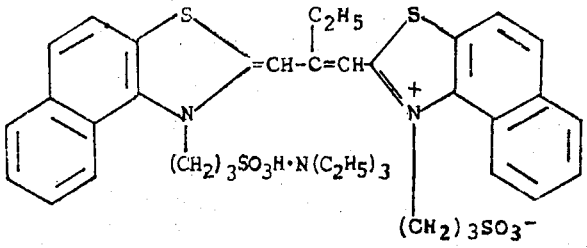

II-3

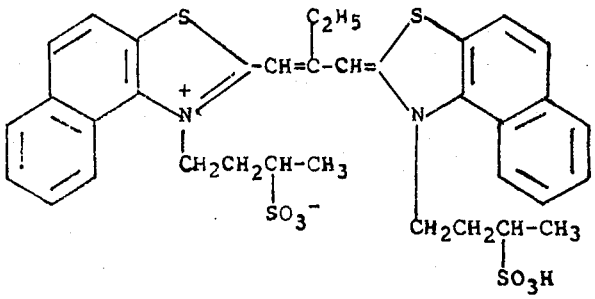

In the technical field of producing silver halide photographic light-sensitive elements, it is well-known that when a sensitizing dye is added to a silver halide emulsion, the region of the light-sensitive wavelength of the silver halide emulsion is broadened, whereby the emulsion can be optically sensitized. For most photographic light-sensitive elements, there is a case in which a kind of sensitizing dye is employed in order to sensitize a desirable region of the spectrally sensitized wavelength. In many cases, however, at least two kinds of sensitizing dyes are employed in a combined state. In the combined use of sensitizing dyes as mentioned above, there are mostly the cases in which the spectral sensitivity of the combined sensitizing dyes is lower than that of its single dye.

Accordingly, it is considered to be one of the most remarkable problems in the spectrally sensitization art to determine combinations of sensitizing dyes having a supersensitizing relation with each other so that it is not adversely influenced by the combination of sensitizing dyes as mentioned above, or preferably, the spectral sensitivity is further elevated by the combination.

However, a severe selectivity is required between the chemical structures of a group of two dyes maintaining a supersensitizing relation. Even when it is considered there is apparently only a slight difference between dyes in their chemical structural formulae, the supersensitizing function is remarkably influenced by the above difference in most cases. Accordingly, it is generally considered to be difficult to predict photographic effects from the chemical structural formula of each dye of the combination.

In other words, the present invention relates to a spectral sensitization upon "flash exposure" as defined above.

It is common that a conventionally known method for elevating spectral sensitivity is based on experimental results obtained by a longer exposure period than that of one-thousandth second. On the other hand, the spectrally sensitizing function obtained by flash exposure differs from exposure of an ordinary period heretofore known and as a result, unexpected results are obtained in most cases.

A photographic light-sensitive element in which the dyes of the above General Formulae (I) and (II) are employed in combination has a high spectral sensitivity upon flash exposure as described in the following examples. That is to say, it was found that excellent supersensitizing effects with respect to flash exposure were obtained by the combined use of the dyes (I) and (II).

In the photographic light-sensitive element according to the present invention, a high sensitivity is obtained over a wide range of wavelengths extending to the end of the red region and color stain due to sensitizing dyes of the light-sensitive element after the treatment is slight, and accordingly, the silver halide photographic light-sensitive element of this invention is particularly suitable for use as light-sensitive elements for quick treatment of information.

Furthermore, it is also possible to elevate the spectral sensitivity in a region of a shorter wavelength by further employing a sensitizing dye which sensitizes a region of shorter wavelength together with the combination of the sensitizing dyes (I) and (II) employed in the present invention. Particularly, a higher sensitivity and panchromatic silver halide photographic light-sensitive element for flash exposure can be obtained by employing a sensitizing dye which sensitizes a region of a short wavelength, being in a supersensitization relation with the sensitizing dye (I) or (II).

As a sensitizing dye of a shorter wavelength, for example, so-called pseudocyanine dyes and the like are useful and particularly, a pseudocyanine dye represented by the following General Formula (III) presenting a remarkable elevation of sensitivity:

General Formula (III)

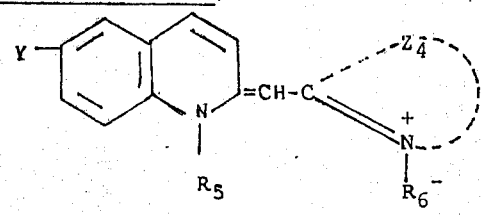

in which Y is a hydrogen atom, a hydroxy group, a lower alkyl group, an alkoxy group, or a halogen atom; $Z_4$ is a non-metallic atomic group required for completing a benzothiazole ring, a benzoselenazole ring, or a 2-quinolin ring; $R_5$ and $R_6$ have the same meaning as $R_1$ and $R_2$, respectively, at least one of $R_5$ and $R_6$ being an alkyl group having a sulfo substituent.

Examples of sensitizing dyes represented by the General Formula (III) will be illustrated hereinbelow.

III-1

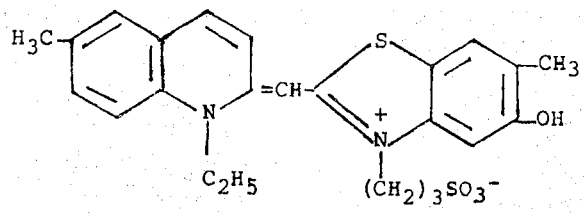

III-2

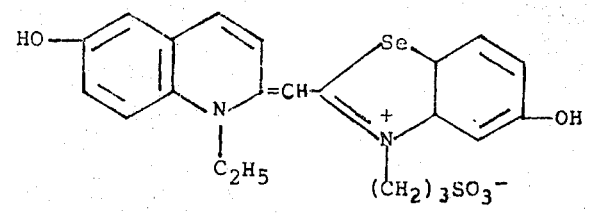

III-3

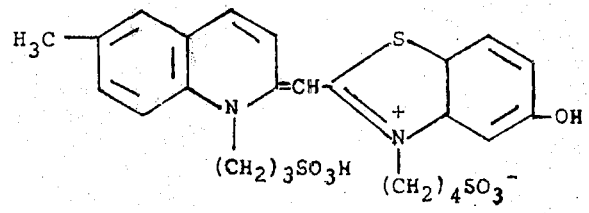

III-4

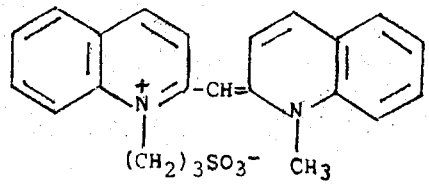

III-5

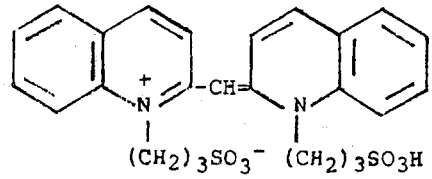

The ratio of the sensitizing dye of the General Formula (I) to the sensitizing dye of the General Formula (II) is not particularly limited, but it is especially effective within a range of from 9:1 to 1:9 by weight and this ratio may be changed in accordance with its purpose, respectively.

For preparing the photographic emulsion employed in the present invention, it is sufficient to add two kinds of the dyes into a photographic emulsion in accordance with an ordinary method. In practicality, it is convenient to add the dyes to the emulsion in the form of a solution prepared from a suitable solvent. A method for adding the sensitizing dye to the photographic emulsion and in general, the sensitizing dye may be added to the photographic emulsion in the form of a solution prepared from a solvent such as water, methanol, ethanol, methyl cellosolve, and the like. The concentration of the dye in the emulsion may be widely varied within a range of, for example, from 1 to 200 mg per 1 kg of the emulsion in accordance with desired effects.

For the silver halide photographic emulsion of the present invention, silver halides such as silver chloride, silver bromide, silver iodobromide, silver chlorobromide or silver chloroiodobromide may be employed. In these silver halide photographic emulsions, compounds of metals of group VIII of the Periodic Table (that is, iron, cobalt, nickel, ruthenium, rhodium, palladium, osmium, iridium, and platinum) or compounds of gold may be separately or jointly employed. The quantity of these metal compounds to be added is within a range of from $10^{-6}$ mol to $10^{-3}$ mol per 1 mol of silver halide, and the metal compound (or compounds) may be added to the emulsion at the time of formation of the silver halide particles in the production of the silver halide emulsion, or initiation of ripening of the emulsion, or on the way of the steps thereof, and further, the metal compound may also be added to the emulsion in the period prior to the application (coating) thereof and after the ripening thereof.

Furthermore, additives ordinarily employed in the production of the photographic emulsions of the present invention, for example, chemical sensitizers, stabilizing agents, toning agents, hardening agents, coating aids, antifoggants, plasticizers, development accelerators, aerial-antifoggants, fluorescent brightening agents, and developing agents for activator development may also be added to the emulsion in accordance with a common manner.

Although a normal gelatinous silver halide emulsion is employed in the present invention, photographic emulsions containing substances other than gelatin such as water permeable colloids, water soluble cellulose derivatives, polyvinyl alcohol other hydrophilic synthetic or natural resins or polymeric compounds can be sufficiently sensitized with the sensitizing dyes of the present invention.

The emulsion employed for the present invention may be applied onto a suitable support such as glass, films of cellulose derivatives, films of synthetic resin, synthetic papers, polyolefin-laminated papers, and baryta paper in accordance with an ordinary manner.

The present invention will be illustrated further by reference to the following non-limiting examples.

EXAMPLE 1

To a photographic emulsion sensitized with gold and containing a silver halide consisting of silver iodobromide (1.5 mol % of silver iodide), a sensitizing dye was added, further, a coating aid and hardening agent were added thereto. The thus-obtained mixture was applied onto a cellulose triacetate base (Quantity of applied silver: 4.5 g/cm$^2$) to prepare sample pieces. The silver content was 1.3 gram equivalents and the gelatin content was 70 grams per 1 kilogram of the resulting emulsion, respectively.

The sample pieces were subjected to exposure for one-hundredth second and one-millionth second by employing a Mark VII sensitometry manufactured by EG & G Co. in U.S.A. through a Fuji filter SC-48 (transmitting light having a wavelength of more than 500 mm therethrough), respectively.

The exposed sample pieces were developed with a developer having the following composition at a temperature of 20°C for 4 minutes.

| | |
|---|---|
| Metol | 2.2 g |
| Anhydrous Sodium Sulfite | 96 g |
| Hydroquinone | 8.8 g |
| Sodium Carbonate (Monohydrate) | 56 g |
| Potassium Bromide | 5 g |
| Water | to 1 liter |

The developed sample pieces were further subjected to normal fixation, rinsing and drying. The optical concentrations of the resulting sample pieces after drying were measured by a densitometer, respectively, and the results are shown in the following Table 1 in which the values of sensitivities are expressed by a reciprocal number of the quantity of light at which a concentration of 0.3 was obtained. In these examples, since the absolute light quantity through the filter was not measured, the values of sensitivity are relative values, but the relative value was considered to be sufficient in these examples, because the respective sensitivities at the same exposing period correspond to each other in the Table.

TABLE 1

| Test No. | Ex. No. | Dye* (Quantity Added ml./Kg Emulsion | | Yellow Sensitivity (Relative Value) One Hundredth sec. Exposure | One-Millionth sec. Exposure |
|---|---|---|---|---|---|
| 1 | | I-1 (80) | — | 100 | 100 |
| | | — | II-2 (40) | 140 | 132 |
| | 1 | I-1 (80) | II-2 (40) | 100 | 238 |
| 2 | | I-2 (40) | — | 100 | 100 |
| | | — | II-2 (20) | 115 | 120 |
| | 2 | I-2 (40) | II-2 (20) | 130 | 210 |
| 3 | | I-3 (40) | — | 100 | 100 |
| | | — | II-2 (20) | 145 | 128 |
| | 3 | I-3 (40) | II-2 (20) | 130 | 207 |
| 4 | | I-1 (40) | II-2 (40) — | 100 | 100 |
| | 4 | I-1 (40) | II-2 (40) III-5 (25) | 130 | 140 |

*The concentration of each dye is $2 \times 10^{-3}$ mol/liter.

What is claimed is:

1. In a method of producing an image comprising exposing a silver halide photographic light sensitive element comprising a support bearing thereon at least one layer of a silver halide photographic emulsion to light for a period of less than 0.0001 seconds, the improvement which comprises incorporating into the emulsion at least one sensitizing dye represented by the following General Formula (I) in combination with at least one sensitizing dye represented by the following General Formula (II):

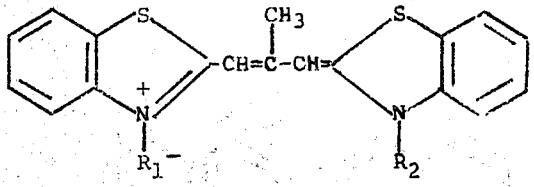

(I)

wherein $R_1$ and $R_2$ each represents an alkyl group, at least one of $R_1$ and $R_2$ being an alkyl group having a sulfo substituent, (II)

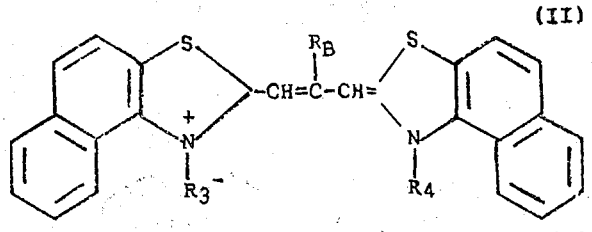

wherein $R_B$ represents a methyl group or an ethyl group, $R_3$ and $R_4$ have the same meaning as $R_1$ and $R_2$, at least one of $R_3$ and $R_4$ being an alkyl group having a sulfo substituent.

2. The image producing method of claim 1, wherein $R_B$ represents an ethyl group.

3. The image producing method of claim 2, wherein the silver halide photographic emulsion further contains at least one sensitizing dye represented by the following General Formula (III)

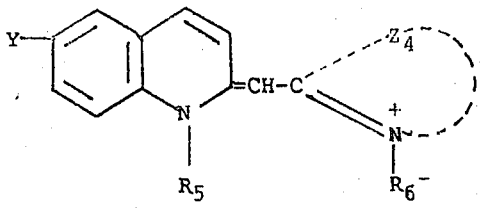

in which Y is a hydrogen atom, a hydroxy group, a lower alkyl group, an alkoxy group, or a halogen atom; $Z_4$ is a non-metallic atomic group required for completing a benzothiazole ring, a benzoselenazole ring, or a 2-quinolin ring; $R_5$ and $R_6$ have the same meaning as $R_1$ and $R_2$, respectively, at least one of $R_5$ and $R_6$ being an alkyl group having a sulfo substituent.

4. The image producing method of claim 2, wherein the dye of the General Formula (I) is selected from the group consisting of

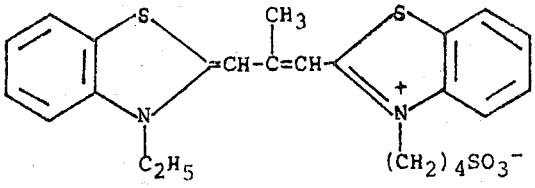

Continued

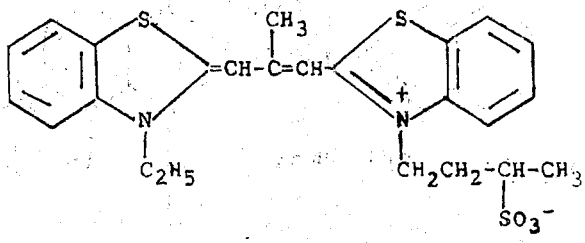

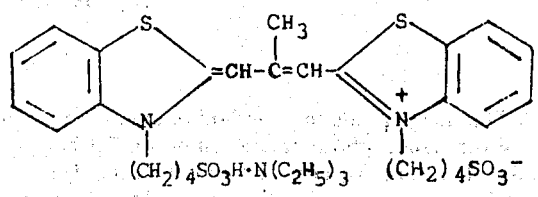

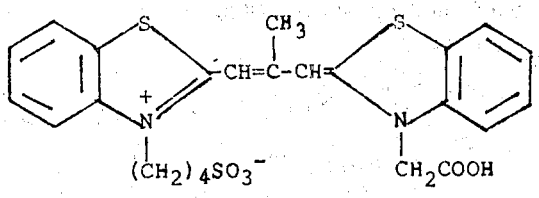

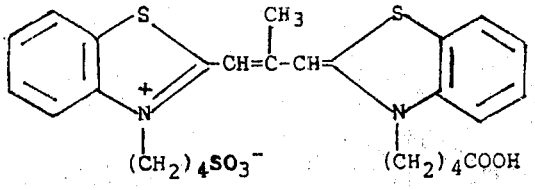

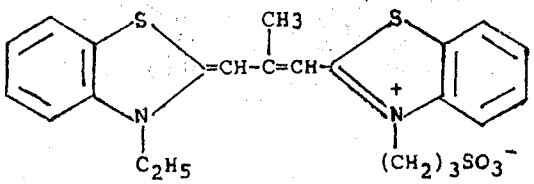

and the dye of the General Formula (II) is selected from the group consisting of

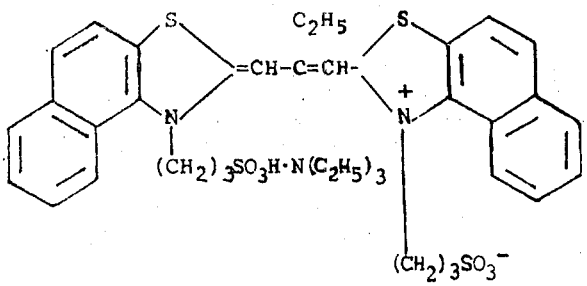

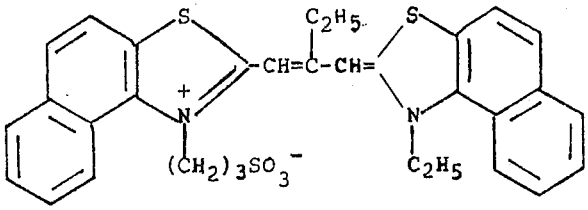

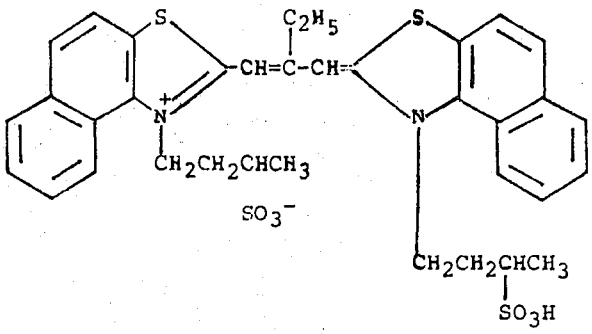

5. The image producing method of claim 2, wherein the silver halide photographic emulsion further contains at least one pseudo cyanine sensitizing dye.

6. The image producing method of claim 3, wherein the dye represented by General Formula (III) is selected from the group consisting of

III-1

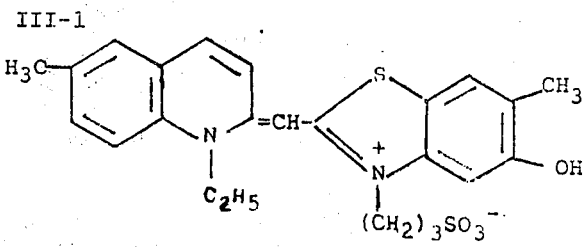

III-2

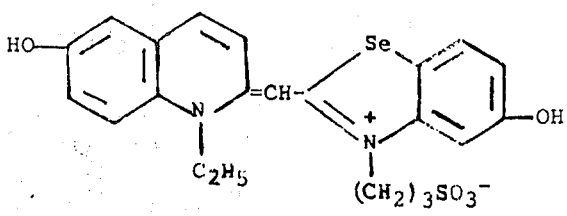

III-3

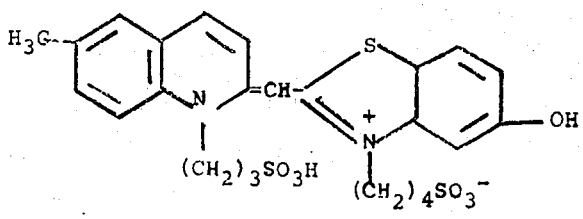

III-4

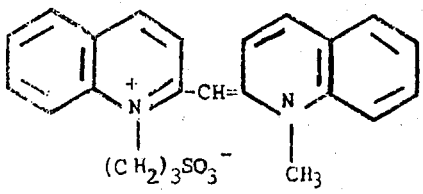

III-5

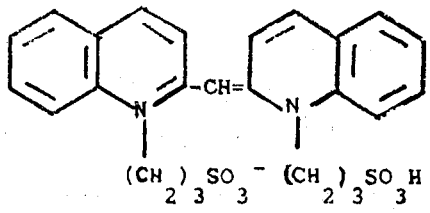

7. The image producing method of claim 2, wherein the silver halide photographic emulsion further contains at least one member selected from the group consisting of a compound of a metal of group VIII of the Periodic Table and a compound of gold.

* * * * *